US007059003B2

(12) United States Patent
Bergemann et al.

(10) Patent No.: US 7,059,003 B2
(45) Date of Patent: Jun. 13, 2006

(54) PROGRAMMABLE HOUSEHOLD APPLIANCE WITH A DISPLAY DEVICE

(75) Inventors: Heinz-Jürgen Bergemann, München (DE); Gundula Czyzewski, Berlin (DE); Konrad Götz, Kelheim (DE); Detlef Jähnert, München (DE); Bernward Reinker, Regenstauf (DE); Matthias Salein, Berlin (DE); Ingo Schulze, Zepernick (DE); Christian Eric Sechelmann, Brieselang (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/816,370

(22) Filed: Apr. 1, 2004

(65) Prior Publication Data

US 2005/0016228 A1 Jan. 27, 2005

Related U.S. Application Data

(63) Continuation of application No. PCT/EP02/08088, filed on Jul. 19, 2002.

(30) Foreign Application Priority Data

Oct. 1, 2001 (DE) ..... 101 48 453

(51) Int. Cl.
*D06F 33/02* (2006.01)

(52) U.S. Cl. ..... 8/158; 68/12.02; 68/12.23

(58) Field of Classification Search ..... 8/158, 8/159; 68/12.02, 12.23
See application file for complete search history.

(56) References Cited

U.S. PATENT DOCUMENTS

| | | | | |
|---|---|---|---|---|
| 4,275,464 | A * | 6/1981 | Schmidt | 714/46 |
| 4,509,543 | A * | 4/1985 | Livingston et al. | 134/57 D |
| 4,756,321 | A * | 7/1988 | Livingston et al. | 134/56 D |
| 4,763,493 | A | 8/1988 | Nishite et al. | |
| 4,803,854 | A * | 2/1989 | Kikuchi et al. | 68/12.27 |
| 4,923,581 | A * | 5/1990 | Day | 204/571 |
| 4,977,394 | A | 12/1990 | Manson et al. | |
| 5,038,807 | A | 8/1991 | Bailey et al. | |
| 5,145,647 | A * | 9/1992 | Murray-Shelley | 422/116 |
| 5,353,612 | A * | 10/1994 | Noguchi et al. | 68/12.02 |
| 5,555,583 | A * | 9/1996 | Berkcan | 8/158 |
| 6,348,956 | B1 * | 2/2002 | Tanigawa et al. | 348/734 |
| 6,425,156 | B1 * | 7/2002 | Knopp et al. | 8/159 |
| 6,523,205 | B1 * | 2/2003 | Broker et al. | 8/158 |

FOREIGN PATENT DOCUMENTS

| | | | |
|---|---|---|---|
| DE | 198 10 222 A1 | | 9/1999 |
| DE | 198 34 230 A1 | | 2/2000 |
| JP | 10-244090 | * | 9/1998 |
| JP | 11-33271 | * | 2/1999 |

* cited by examiner

*Primary Examiner*—Frankie L. Stinson
(74) *Attorney, Agent, or Firm*—John T. Winburn; Russell W. Warnock; Craig J. Loest

(57) ABSTRACT

The invention allows a user of a program-controlled household appliance to obtain comprehensive information concerning different working process parameters by having the appliance include a display device for acoustic signals or optical characters and a memory area of the program control device, which is configured for saving set program parameters and measurement and operational values of the actuators and sensors participating in the program that is running. For such a purpose, the display device contains a display element (field), which is activated upon completion of the working process and contains the comment "Log", indicating the option of issuing information relating to measurement and operational values that have been saved prior to and/or during the last completed working process.

29 Claims, 2 Drawing Sheets

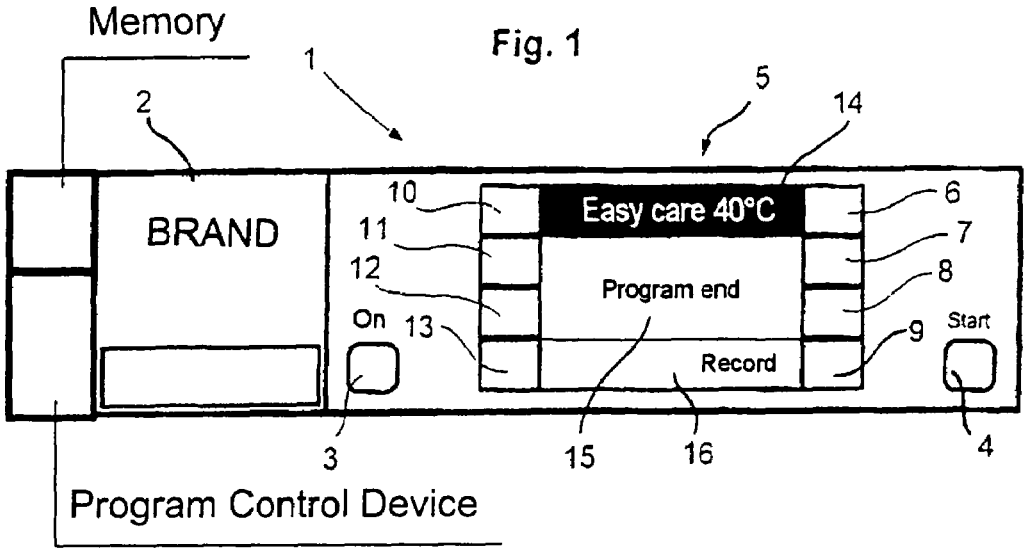
Fig. 2
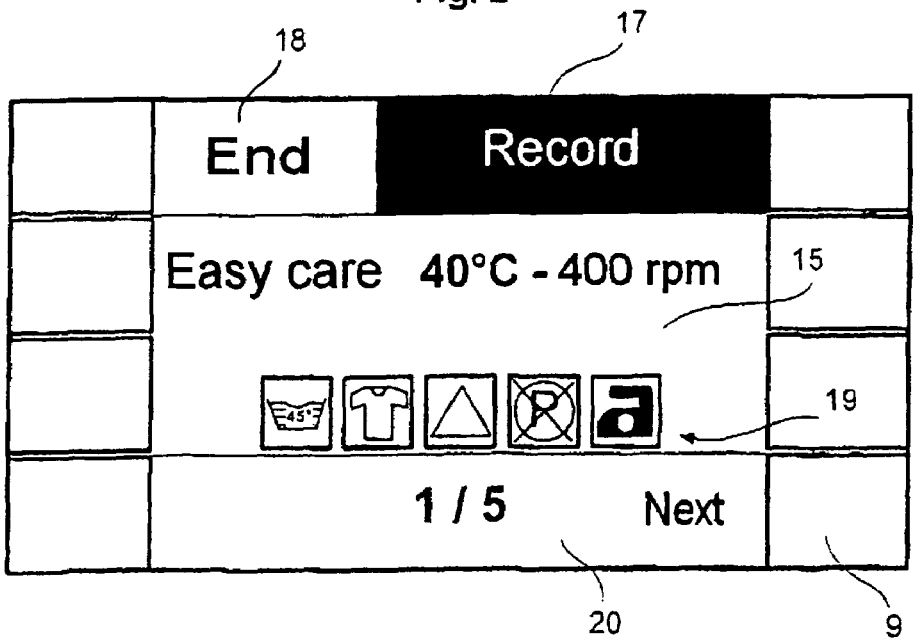

PROGRAMMABLE HOUSEHOLD APPLIANCE WITH A DISPLAY DEVICE

CROSS-REFERENCE TO RELATED APPLICATION

This application is a continuation, under 35 U.S.C. § 120, of copending international application No. PCT/EP02/08088, filed Jul. 19, 2002, which designated the United States; this application also claims the priority, under 35 U.S.C. § 119, of German patent application No. 101 48 453.4, filed Oct. 1, 2001; the prior applications are herewith incorporated by reference in their entirety.

BACKGROUND OF THE INVENTION

Field of the Invention

The invention relates to a programmable household appliance with a display device for audible or visual symbols and with a memory area for the program control device, which is configured to store selected program parameters and to store measurement and operating values of the actuators and sensors that are involved in the operating process taking place.

Such a household appliance is described based upon a washing machine in German Published, Non-Prosecuted Patent Application DE 198 34 230 A1. For such a household appliance, it will be desirable for the user to be able to obtain information about the manner in which the work program that was previously selected by him and is associated with ingredients was actually carried out. For example, the user of a washing machine could verify, from his washing, the washing and spin-drying result that has been achieved. However, if the result is unsatisfactory in any way whatsoever, the user generally does not know the reason why the washing or spin-drying result has not led to him being satisfied. Such an unsatisfied user will often contact customer service even though, if he were to know the circumstances that had actually occurred with regard to the operating process being complained about, he could possibly have satisfied himself by changing the procedure for inputting parameters for future operating processes.

SUMMARY OF THE INVENTION

It is accordingly an object of the invention to provide a programmable household appliance with a display device that overcomes the hereinafore-mentioned disadvantages of the heretofore-known devices of this general type and that provides the customer for a household appliance of the type mentioned initially with the capability to obtain details about the work program that was in each case most recently carried out.

With the foregoing and other objects in view, in a programmable household appliance having actuators and sensors involved in an operating process, there is provided, in accordance with the invention, a display assembly for at least one of audible and visual symbols including a program control device connected to the actuators and sensors, a memory connected to the program control device, the program control device being programmed to store in the memory selected program parameters and measurement and operating values of the actuators and sensors, a display element for at least one of audible and visual symbols, the display element being connected to the program control device, and the program control device being programmed to switch on the display element once the operating process has completed and to cause the display element to display information about an ability to output information regarding the measurement and operating values stored at least one of before and during the operating process most recently carried out.

With the objects of the invention in view, in a programmable household appliance having actuators and sensors involved in an operating process, a memory, and a program control device connected to the memory, to the actuators, and to the sensors, the program control device being programmed to store in the memory selected program parameters and measurement and operating values of the actuators and sensors, there is also provided a display assembly for at least one of audible and visual symbols including a display element connected to the program control device, the display element being switched on by the program control device once the operating process has completed, and displaying information about a capability to output information about the measurement and operating values stored at least one of before and during the operating process most recently carried out.

With the objects of the invention in view, in a programmable household appliance, there is also provided a control system including a program control device, actuators and sensors involved in an operating process of the appliance, the actuators and the sensors connected to the program control device, a display for at least one of audible and visual symbols being connected to the program control device, the display device having a display element, a memory area connected to the program control device, the program control device being programmed to store in the memory selected program parameters and measurement and operating values of the actuators and sensors, and to switch on the display element once the operating process has completed and to display with the display element information about a capability to output information about the measurement and operating values stored at least one of before and during the operating process most recently carried out.

With the objects of the invention in view, there is also provided a display for a programmable household appliance having a program control device, actuators, sensors, a memory for the program control device storing selected program parameters and storing measurement and operating values of the actuators and sensors involved in an operating process taking place, the display including a display device for at least one of audible and visual symbols, the display device having a display element switched on once the operating process has completed, the display element displaying information about a capability to output information about the measurement and operating values that were stored at least one of before and during the operating process that was most recently carried out.

According to the invention, the display device has a display element that is switched on once the operating process has been completed, and includes information about the capability to output information about measurement and operating values that were stored before and/or during the operating process that was most recently carried out. Such a capability informs the user of a household appliance, without him having to do anything else, of whether or not the previously selected operating process was actually carried out in the way that the user had envisaged the process based upon the settings made.

Specifically, at the end of an operating process that has been carried out, appropriate information can be displayed to the user, if the subject matter of the invention is integrated in the household appliance. If a speech module is fitted, the information may, for example, be output audibly. If a display is provided, however, such information can also be displayed visually.

Specifically, if the display device has an at least single-line display and the information is an image of an alphanumeric word that can be interpreted by the operator, the user can use this to obtain information relating to stored parameters that can be called up about the operating process that has most recently been carried out.

In accordance with another feature of the invention, the word should be understood as being information about a record that can be called up by the operator about the work program that was most recently carried out. By way of example, this actually may be the word "record."

If the display element has an associated operating device, whose operation makes it possible to initiate a sequence of information outputs about measurement and operating values, the user can retrieve the information from the record directly on the display, and can read it. For such a purpose, the information (which, for example, is in audible form) can be initiated by a request, which is, likewise, in audible form. However, the operating device may also be a key that can be operated manually in the manner corresponding to previously normal usage and is disposed physically alongside the visual display element of a multi-line display. Then, by way of example, the sequence of information outputs can be continued item by item whenever the operating device is operated.

In this way, the information that is desired by the user can be read directly from the display and can be compared with the user's pre-selected settings.

In accordance with a further feature of the invention, the display element has a multi-line display with a visual display element and the operating device is a manually operated key disposed alongside the visual display element.

In accordance with an added feature of the invention, the measurement values relate to a measured program duration.

The information that can be output may relate to the selected program parameters for the operating process that was most recently carried out. However, instead of the program parameters or in addition to them, the information may also relate to the measurement and operating values for the operating process that was most recently carried out.

Measurement values such as these may be the automatically determined load quantity with washing to be treated, the amount of energy consumed, the amount of water consumed, the intensity of treatment sections, specifically, the main washing and/or rinsing, the final rinsing, or spin drying.

The operating values to be checked in a washing machine or dishwasher may relate to foam identification and, in a washing machine, may relate to the spin-drying program section procedure. In such a case, it is of particular interest whether or not and how often the start of spin drying was terminated as a result of an unbalance that was classified as excessive, and/or whether or not the spin-drying rotation speed was possibly reduced for this reason. Further program sections, which will not be mentioned in any more detail here, in washing machines or other programmable household appliances may, likewise, be the object of retrospective considerations.

Other features that are considered as characteristic for the invention are set forth in the appended claims.

Although the invention is illustrated and described herein as embodied in a programmable household appliance with a display device it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1 is a diagrammatic front elevational view of a control panel for a washing machine with a display equipped according to the invention;

FIG. 2 is a diagrammatic enlarged elevational view of the display of FIG. 1, illustrating the preselected program parameters;

DESCRIPTION OF THE PREFERRED EMBODIMENTS

Figure 3:
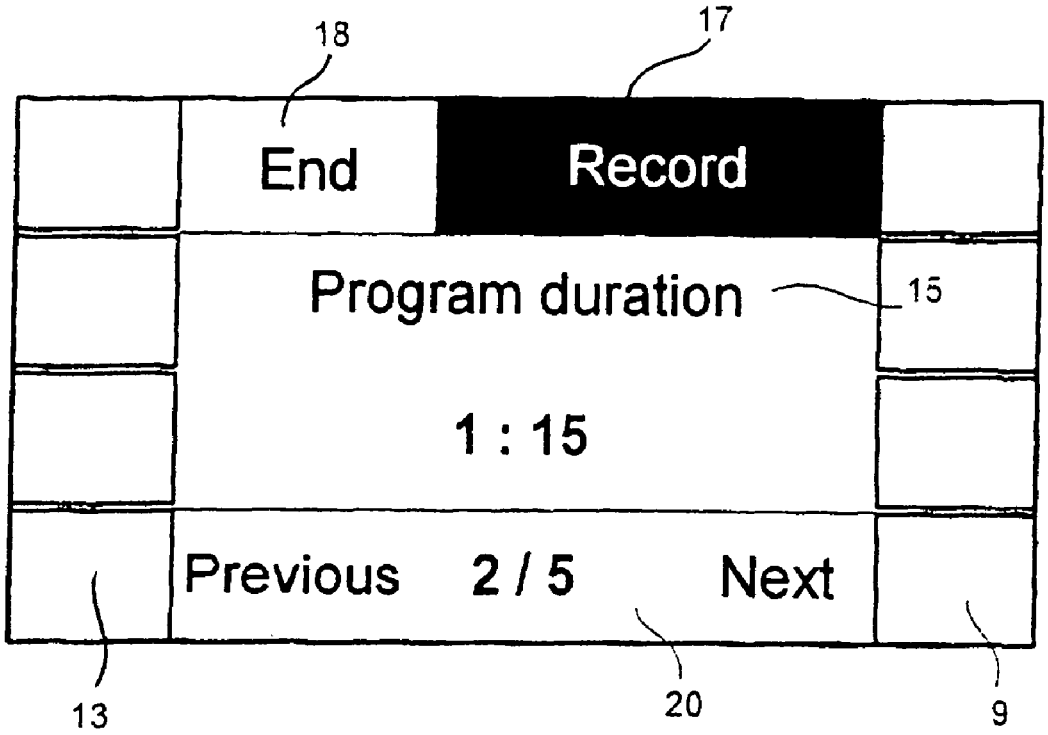
FIG. 3 is a diagrammatic elevational view of the display of FIG. 2 illustrating a measurement value for the program duration.

Referring now to the figures of the drawings in detail and first, particularly to FIG. 1 thereof, there is shown a handle plate 2 for a detergent drawer, normally disposed on one side of the control panel 1 of a washing machine, but of no importance for the invention. The control panel 1 has two keys 3 and 4 for electrical connection of the washing machine to the mains power supply "On" and for starting up the selected operating process "Start." The display 5 is flanked on the right and left by a column of keys 6 to 9 and 10 to 13, respectively. The state shown by the display 5 in FIG. 1 relates to the program end of an "Easy care 40° C." operating process that has been carried out (display in field 14). The image of the phrase "Program end" in field 15 signals the end of the operating process that has been carried out. The field 16 shows the word "Record" immediately alongside the key 9 and, thus, indicates that a record of the operating process that has most recently been carried out can be called up by pushing the key 9. An image as shown in FIG. 2, then, appears on the display 5.

In such a case, the previous field 14 has been subdivided into the fields 17 and 18. The field 17 now shows the "Record" state, and the field 18 shows the "End" option. Field 15 now shows the selected data for the chosen program in the first of five possible images. In such a case, washing factors that have been taken into account are displayed by the icons 19, which need not necessarily apply to the chosen program in the present example, but are merely intended to represent an example. The field 20, on one hand, shows at (1/5) that the display shown is the first of five possible displays.

On the other hand, the word "Next" shown on the right alongside the key 9 indicates that operation of the key 9 will result in the next (second) of the five possible displays being displayed.

The second of the five displays is shown in FIG. 3. While the displays in the fields 17 and 18 have not changed, the field 15 now indicates the program duration. The words "Program duration" and, for example, "1:15" are displayed for such a purpose, indicating that the operating process that was carried out actually lasted for one hour and 15 minutes. The predicted program duration when displaying the selected program before the start of the operating process may, perhaps, have been only 1 hour and 5 minutes. Following the display "1:15", the user now knows that the operating process actually took 10 minutes longer. In addition to the display "2/5" for the second of five possible displays of recorded parameters in the field 20, the word "Previous" now also indicates that the previous display (1/5as shown in FIG. 2) can be returned to on the display by operating the key 13 located alongside it.

Figure 4:
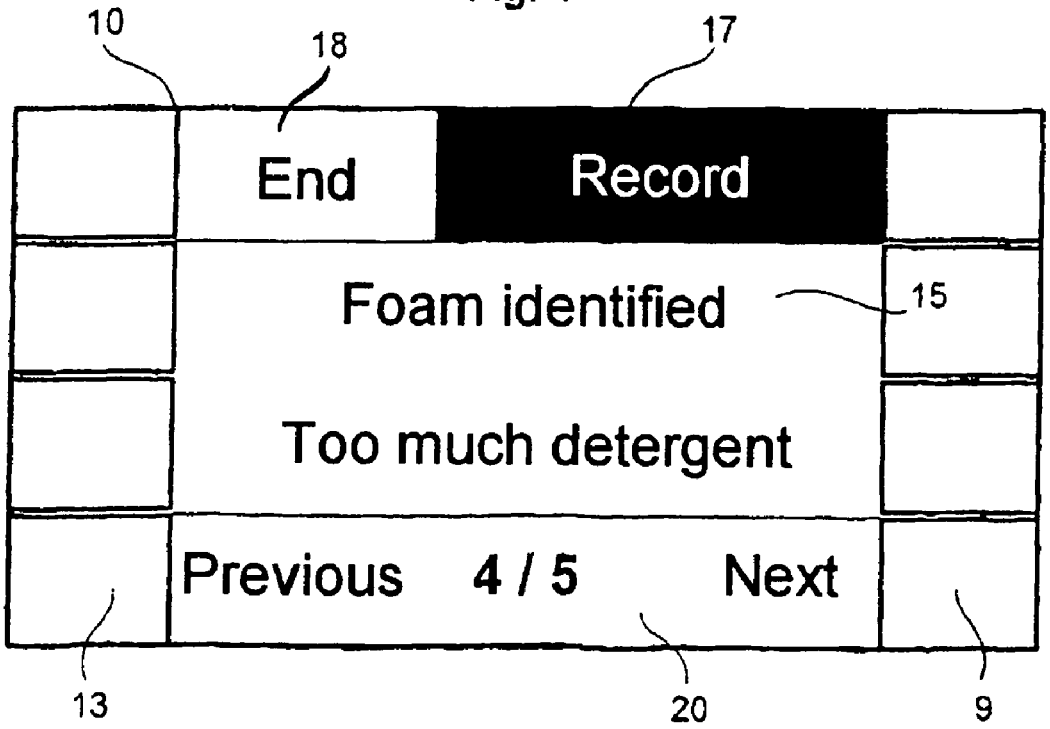
FIG. 4 is a diagrammatic elevational view of the display of FIG. 2 illustrating an operating value for foam formation in the rinsing phase of the work program that has been carried out.

FIG. 4 shows a display "4/5" after scrolling through the display "3/5", in which the field 15 shows an operating value, specifically, "Foam identified," which indicates that foam formation in the rinsing suds was still sensed at the end of the rinsing phase within the operating process. Furthermore, the program system has used this to generate the statement that "Too much detergent" was used and, likewise, indicates this in the field 15.

As soon as the key 10 that is located on the left alongside the field 18 "End" is pressed, the record display is deleted.

The display, then, may either be switched off completely or may, once again, indicate the same display as immediately after the program end (as in FIG. 1).

In contrast to the described exemplary embodiment and without departing from the invention, further parameters may, of course, also be displayed as measurement or operating values. More or less than five pages (or display levels) may be selected on the display for this purpose. The display would, then, change in a corresponding manner to "a/x".

In addition, any of the recorded measurement values or operating values can be output audibly if the record output function is indicated audibly, as already mentioned further above.

The measures according to the invention for a household appliance improve the customer usefulness and help the customer to learn how to save energy and resources. In addition, the customer is, in this way, made more familiar with the sensor system used in a household appliance.

We claim:

1. In a programmable household appliance having actuators and sensors involved in an operating process, a display assembly for at least one of audible and visual symbols comprising:

a program control device connected to the actuators and sensors;

a memory connected to said program control device, said program control device being programmed to store in said memory selected program parameters and measurement and operating values of the actuators and sensors;

a display element for at least one of audible and visual symbols, said display element being connected to said program control device; and said program control device being programmed:

to switch on said display element once the operating process has completed; and to cause said display element to display information about an ability to output information regarding said measurement and operating values stored at least one of before and during the operating process most recently carried out.

2. The household appliance according to claim 1, wherein said display element has an at least one-line display and said information is an image of an alphanumeric word interpreted by a user.

3. The household appliance according to claim 2, wherein said word is information about a record to be called up by the user about a work program most recently carried out.

4. The household appliance according to claim 1, wherein said display element has an operating device that, upon operation thereof, initiates a sequence of information outputs about said measurement and operating values.

5. The household appliance according to claim 4, wherein:

said display element has a multi-line display with a visual display element; and said operating device is a manually operated key disposed alongside said visual display element.

6. The household appliance according to claim 4, wherein each operation of said operating device continues said sequence of information outputs item-by-item.

7. The household appliance according to claim 1, wherein said information relates to selected program parameters for the operating process most recently carried out.

8. The household appliance according to claim 1, wherein said information relates to said measurement and operating values for the operating process most recently carried out.

9. The household appliance according to claim 8, wherein said measurement values relate to a measured program duration.

10. The household appliance according to claim 8, wherein:

the appliance is a washing machine; and said measurement values relate to an automatically determined load quantity with washing to be treated.

11. The household appliance according to claim 8, wherein said measurement values relate to an amount of energy consumed.

12. The household appliance according to claim 8, wherein:

the appliance is selected from one of the group consisting of a washing machine and a dishwasher; and said measurement values relate to an amount of water consumed.

13. The household appliance according to claim 8, wherein said measurement values relate to an intensity of treatment sections.

14. The household appliance according to claim 13, wherein:

the appliance is selected from one of the group consisting of a washing machine and a dishwasher; and said treatment section is at least one of a main washing, a main rinsing, and a rinsing.

15. The household appliance according to claim 13, wherein:

the appliance is selected from one of the group consisting of a washing machine and a dishwasher; and said treatment section is a final rinsing.

16. The household appliance according to claim 13, wherein:

the appliance is a washing machine; and said treatment section is spin drying.

17. The household appliance according to claim 8, wherein:

the appliance is selected from one of the group consisting of a washing machine and a dishwasher; and said operating values relate to foam identification.

18. The household appliance according to claim 8, wherein:

the appliance is a washing machine; and said operating values relate to a spin-drying program section procedure.

19. In a programmable household appliance having actuators and sensors involved in an operating process, a memory, and a program control device connected to the memory, to the actuators, and to the sensors, the program control device being programmed to store in the memory selected program parameters and measurement and operating values of the actuators and sensors, a display assembly for at least one of audible and visual symbols comprising:

a display element connected to the program control device, said display element:

being switched on by said program control device once the operating process has completed; and displaying information about a capability to output information about said measurement and operating values stored at least one of before and during the operating process most recently carried out.

20. In a programmable household appliance, a control system comprising:

a program control device;

actuators and sensors involved in an operating process of the appliance, said actuators and said sensors connected to said program control device;

a display for at least one of audible and visual symbols being connected to said program control device, said display device having a display element;

a memory area connected to said program control device, said program control device being programmed:

to store in said memory:

selected program parameters; and measurement and operating values of the actuators and sensors;

to switch on said display element once the operating process has completed and to display with said display element information about a capability to output information about said measurement and operating values stored at least one of before and during the operating process most recently carried out.

21. A method for operating a programmable household appliance having actuators and sensors involved in an operating process, which comprises:

providing a program control device with a memory and a display element for displaying at least one of audible and visual symbols;

connecting the program control device to the actuators and the sensors;

recording selected program parameters of the operating process in the memory at least one of before and during the operating process;

storing in the memory at least one of measurement values and operating values of at least one of the actuators and the sensors at least one of before, during, and after the operating process; and switching on the display element with the program control device once an operating process has completed and displaying, on the display element, information about an ability to output information regarding the selected program parameters and the measurement and operating values stored at least one of before, during, and after the operating process most recently carried out.

22. The method according to claim 21, which further comprises:

providing the display element with an operating device; and initiating a sequence of information outputs about the measurement and operating values upon operation of the operating device.

23. The method according to claim 22, which further comprises successively operating the operating device to sequentially display the information outputs item-by-item.

24. The method according to claim 21, which further comprises outputting information on the display including at least one of:

at least one of the program parameters for the operating process most recently carried out; and at least one of the measurement and operating values for the operating process most recently carried out.

25. The method according to claim 24, wherein the measurement values include a measured program duration.

26. The method according to claim 24, which further comprises:

providing the program control device, the memory, and the display element in a washing machine; and storing measurement values including at least one of:

an automatically determined load quantity with washing to be treated;

an intensity of treatment sections;

an amount of energy consumed; and an amount of water consumed; and storing operating values include at least one of foam identification and a spin-drying program section procedure.

27. The method according to claim 26, which further comprises storing treatment sections including at least one of a main washing, a main rinsing, a rinsing, a final rinsing, and spin drying.

28. The method according to claim 24, which further comprises:

providing the program control device, the memory, and the display element in a dishwasher; and storing measurement values including:

an automatically determined load quantity with washing to be treated;

an intensity of treatment sections;

an amount of energy consumed; and an amount of water consumed.

29. The method according to claim 28, storing treatment sections including at least one of a main washing, a main rinsing, a rinsing, and a final rinsing.

* * * * *